US011905580B2

(12) United States Patent
Kamitani et al.

(10) Patent No.: US 11,905,580 B2
(45) **Date of Patent: *Feb. 20, 2024**

(54) SEAMLESS STEEL PIPE SUITABLE FOR USE IN SOUR ENVIRONMENT

(71) Applicant: NIPPON STEEL CORPORATION, Tokyo (JP)

(72) Inventors: Hiroki Kamitani, Tokyo (JP); Nobuaki Komatsubara, Tokyo (JP); Seiya Okada, Tokyo (JP); Atsushi Soma, Tokyo (JP); Yuji Arai, Tokyo (JP); Shinji Yoshida, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 265 days.

This patent is subject to a terminal disclaimer.

(21) Appl. No.: 17/259,651

(22) PCT Filed: Sep. 26, 2019

(86) PCT No.: PCT/JP2019/037758

§ 371 (c)(1),
(2) Date: Jan. 12, 2021

(87) PCT Pub. No.: WO2020/071219

PCT Pub. Date: Apr. 9, 2020

(65) Prior Publication Data

US 2021/0317553 A1 Oct. 14, 2021

(30) Foreign Application Priority Data

Oct. 1, 2018 (JP) ..... 2018-187006

(51) Int. Cl.
*C22C 38/32* (2006.01)
*C21D 9/08* (2006.01)
(Continued)

(52) U.S. Cl.
CPC ..... *C22C 38/32* (2013.01); *C21D 9/085* (2013.01); *C22C 38/002* (2013.01); *C22C 38/02* (2013.01);
(Continued)

(58) Field of Classification Search
CPC . C21D 1/18; C21D 1/25; C21D 8/105; C21D 9/08; C21D 9/085; C21D 6/002;
(Continued)

(56) References Cited

U.S. PATENT DOCUMENTS 11,313,005 B2 * 4/2022 Soma ..... F16L 9/02
2007/0137736 A1 6/2007 Omura et al.
(Continued)

FOREIGN PATENT DOCUMENTS

CA 3035163 A1 3/2018
EP 2749664 A1 7/2014
(Continued)

*Primary Examiner* — Jie Yang
(74) *Attorney, Agent, or Firm* — Greer, Burns & Crain, Ltd.

(57) ABSTRACT

The seamless steel pipe according to the present disclosure has a chemical composition consisting of, in mass %, C: 0.15 to 0.45%, Si: 0.05 to 1.00%, Mn: 0.01 to 1.00%, P: 0.030% or less, S: 0.0050% or less, Al: 0.005 to 0.070%, Cr: 0.30 to 1.50%, Mo: 0.25 to 2.00%, Ti: 0.002 to 0.020%, Nb: 0.002 to 0.100%, B: 0.0005 to 0.0040%, rare earth metal: 0.0001 to 0.0015%, Ca: 0.0001 to 0.0100%, N: 0.0100% or less and O: 0.0020% or less, with the balance being Fe and impurities, and satisfying Formula (1) described in the description. A predicted maximum major axis of inclusions is 150 μm or less, the predicted maximum major axis being predicted by means of extreme value statistical processing. The yield strength is within a range of 758 to 862 MPa.

17 Claims, 1 Drawing Sheet

(51) Int. Cl.

| | |
|---|---|
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/26*** | (2006.01) |
| ***C22C 38/28*** | (2006.01) |

(52) U.S. Cl.
CPC ..... *C22C 38/04* (2013.01); *C22C 38/06* (2013.01); *C22C 38/26* (2013.01); *C22C 38/28* (2013.01)

(58) Field of Classification Search
CPC ..... C22C 38/002; C22C 38/005; C22C 38/26; C22C 38/12; C22C 38/32; C22C 38/28
USPC ..... 420/106
See application file for complete search history.

(56) References Cited

U.S. PATENT DOCUMENTS

| | | | | |
|---|---|---|---|---|
| 2012/0186704 | A1 | 7/2012 | Eguchi et al. | |
| 2016/0060738 | A1* | 3/2016 | Nagao | C21D 6/005 420/104 |
| 2019/0226039 | A1* | 7/2019 | Yuga | C22C 38/22 |
| 2019/0300979 | A1* | 10/2019 | Soma | C22C 38/00 |

FOREIGN PATENT DOCUMENTS

| | | | | |
|---|---|---|---|---|
| EP | 3460086 | A4 | 3/2019 | |
| JP | 2000256783 | A | 9/2000 | |
| JP | 2000297344 | A | 10/2000 | |
| JP | 2005350754 | A | 12/2005 | |
| JP | 2012026030 | A | 2/2012 | |
| WO | 2010150915 | A1 | 12/2010 | |
| WO | WO-2017200033 | A1 * | 11/2017 | B21B 19/04 |

* cited by examiner

SEAMLESS STEEL PIPE SUITABLE FOR USE IN SOUR ENVIRONMENT

This is a National Phase Application filed under 35 U.S.C. § 371, of International Application No. PCT/JP2019/037758, filed Sep. 26, 2019, the contents of which are incorporated by reference.

TECHNICAL FIELD

The present invention relates to a steel pipe, and more particularly relates to a seamless steel pipe.

BACKGROUND ART

Due to the deepening of oil wells and gas wells (hereunder, oil wells and gas wells are collectively referred to as "oil wells"), there is a demand to enhance the strength of oil-well steel pipes. Specifically, 80 ksi grade (yield strength is 80 to less than 95 ksi, that is, 552 to less than 655 MPa) and 95 ksi grade (yield strength is 95 to less than 110 ksi, that is, 655 to less than 758 MPa) oil-well steel pipes are being widely utilized, and recently requests are also starting to be made for 110 ksi grade (yield strength is 110 to 125 ksi, that is, 758 to 862 MPa) oil-well steel pipes.

Most deep wells are in a sour environment containing corrosive hydrogen sulfide. In the present description, the term "sour environment" means an acidified environment containing hydrogen sulfide. Note that, in some cases a sour environment may also contain carbon dioxide. Oil-well steel pipes for use in such sour environments are required to have not only high strength, but to also have sulfide stress cracking resistance (hereunder, referred to as "SSC resistance").

Technology for enhancing the SSC resistance of oil-well steel pipes is disclosed in Japanese Patent Application Publication No. 2000-256783 (Patent Literature 1), Japanese Patent Application Publication No. 2000-297344 (Patent Literature 2), Japanese Patent Application Publication No. 2005-350754 (Patent Literature 3), Japanese Patent Application Publication No. 2012-26030 (Patent Literature 4), and International Application Publication No. WO 2010/150915 (Patent Literature 5).

A high-strength oil-well steel disclosed in Patent Literature 1 contains, in weight %, C: 0.2 to 0.35%, Cr: 0.2 to 0.7%, Mo; 0.1 to 0.5% and. V; 0.1 to 0.3%, The amount of precipitating carbides is within the range of 2 to 5 weight percent, and among the precipitating carbides the proportion of MC-type: carbides is within the range of 8 to 40 weight percent, and the prior-austenite grain size is No. 11 or higher in terms of the grain size numbers defined in ASTM. It is described in Patent Literature 1 that the aforementioned high-strength oil-well steel is excellent in toughness and sulfide stress corrosion cracking resistance.

A steel for oil wells that is disclosed in Patent Literature 2 is a low-alloy steel containing, in mass %, C: 0.15 to 0.3%, Cr: 0.2 to 1.5%, Mo: 0.1 to 1%, V: 0.05 to 0.3% and Nb: 0.003 to 0.1%. The amount of precipitating carbides is within the range of 1.5 to 4% by mass, the proportion that MC-type carbides occupy among the amount of carbides is within the range of 5 to 45% by mass, and when the wall thickness of the product is taken as t (mm), the proportion of $M_{23}C_6$-type carbides is (200/t) or less in percent by mass. It is described in Patent Literature 2 that the aforementioned steel for oil wells is excellent in toughness and sulfide stress corrosion cracking resistance.

A steel for low-alloy oil country tubular goods disclosed in Patent Literature 3 contains, in mass %. C: 0.20 to 0.35%. Si: 0.05 to 0.5%. Mn: 0.05 to 1.0%, P: 0.025% or less, S: 0.010% or less, Al: 0.005 to 0.10%, Cr: 0.1 to 1.0%, Mo: 0.5 to 1.0%, Ti: 0.002 to 0.05%, V: 0.05 to 0.3%, B: 0.0001 to 0.005%, N: 0.01% or less and O (oxygen): 0.01% or less. A half-value width H and a hydrogen diffusion coefficient D ($10^{-6}$ $cm^2/s$) satisfy the expression ($30H+D \leq 19.5$). It is described in Patent Literature 3 that the aforementioned steel for low-alloy oil country tubular goods has excellent SSC resistance even when the steel has high strength with a yield stress (YS) of 861 MPa or more.

An oil-well steel pipe disclosed in Patent Literature 4 has a composition consisting of, in mass %, C: 0.18 to 0.25%, Si: 0.1 to 0.3%, Mn: 0.4 to 0.8%, P: 0.015% or less, S: 0.005% or less, Al: 0.01 to 0.1%, Cr: 0.3 to 0.8%, Mo: 0.5 to 1.0%, Nb: 0.003 to 0.015%, Ti: 0.002 to 0.05% and B: 0.003% or less, with the balance being Fe and unavoidable impurities. In the microstructure of the aforementioned oil-well steel pipe, a tempered martensite phase is the main phase, the number of $M_3C$ or $M_2C$ included in a region of 20 μm×20 μm and having an aspect ratio of 3 or less and a major axis of 300 nm or more when the carbide shape is taken as elliptical is not more than 10, the content of $M_{23}C_6$ is less than 1% by mass, acicular $M_2C$ precipitates inside the grains, and the amount of Nb precipitating as carbides having a size of 1 μm or more is less than 0.005% by mass. It is described in Patent Literature 4 that the aforementioned oil-well steel pipe is excellent in sulfide stress cracking resistance even when the yield strength is 862 MPa or more.

A seamless steel pipe for oil ells disclosed in Patent Literature 5 has a composition consisting of, in mass %, C: 0.15 to 0.50%, Si: 0.1 to 1.0%, Mn: 0.3 to 1.0%, P: 0.015% or less, S: 0.005% or less, Al: 0.01 to 0.1%, N: 0.01% or less, Cr: 0.1 to 1.7%, Mo: 0.4 to 1.1%, V: 0.01 to 0.12% Nb: 0.01 to 0.08% and B: 0.0005 to 0.003%, in which the proportion of Mo that is contained as dissolved Mo is 0.40% or more, with the balance being Fe and unavoidable impurities. In the microstructure of the aforementioned oil-well steel pipe, a tempered martensite phase is the main phase, the grain size number of prior-austenite grains is 8.5 or higher, and substantially particulate $M_2C$-type precipitates are dispersed in an amount of 0.06% by mass or more. It is described in Patent Literature 5 that the aforementioned seamless steel pipe for oil wells has both a high strength of 110 ksi grade and excellent sulfide stress cracking resistance.

CITATION LIST

Patent Literature

Patent Literature 1: Japanese Patent Application Publication No. 2000-256783

Patent Literature 2: Japanese Patent Application Publication No. 2000-297344

Patent Literature 3: Japanese Patent Application Publication No. 2005-350754

Patent Literature 4: Japanese Patent Application Publication No. 2012-26030

Patent Literature 5: International Application Publication No. WO 2010/150915

SUMMARY OF INVENTION

Technical Problem

As described above, oil-well steel pipes that are adjusted to a desired yield strength and with which excellent SSC resistance is obtained are proposed in Patent Literatures 1 to 5. On the other hand, apart from SSC, hydrogen-induced cracking (hereunder, referred to as "HIC") may occur in some cases in seamless steel pipes usable in a sour environment. HIC is cracking that occurs due to hydrogen that arose due to a corrosion reaction in a sour environment penetrating into the seamless steel pipe. In short, unlike SSC, HIC occurs even in a case where stress is not being applied.

In other words, there is a possibility of HIC occurring in a seamless steel pipe that is being used as an oil-well steel pipe. However, almost no studies have been carried out with regard to HIC resistance for seamless steel pipes having a yield strength of 110 ksi grade (758 to 862 MPa).

An objective of the present disclosure is to provide a seamless steel pipe that has a yield strength of 758 to 862 MPa (110 to 125 ksi, 110 ksi grade) and also has excellent HIC resistance.

Solution to Problem

A seamless steel pipe according to the present disclosure has a chemical composition consisting of, in mass %, C: 0.15 to 0.45%, Si: 0.05 to 1.00%, Mn: 0.01 to 1.00%, P: 0.030% or less, S: 0.0050% or less, Al: 0.005 to 0.070%. Cr: 0.30 to 1.50%, Mo: 0.25 to 2.00%. Ti: 0.002 to 0.020%, Nb: 0.002 to 0.100%, B: 0.0005 to 0.0040%, rare earth metal: 0.0001 to 0.0015%, Ca: 0.0001 to 0.0100%, N: 0.0100% or less, O: 0.0020% or less, V: 0 to 0.30%, Mg: 0 to 0.0100%, Zr: 0 to 0.0100%, Co: 0 to 1.00%, W: 0 to 1.00%, Ni: 0 to 0.50% and Cu: 0 to 0.50%, with the balance being Fe and impurities, and satisfying Formula (1). In the seamless steel pipe according to the present disclosure, a maximum major axis of inclusions in the seamless steel pipe is 150 μm or less, the maximum major axis being predicted by means of extreme value statistical processing. The seamless steel pipe according to the present disclosure has a yield strength within a range of 758 to 862 MPa.

$$(Ca/O+Ca/S+0.285\times REM/O+0.285\times REM/S)\times(Al/Ca)\geq 40.0 \quad (1)$$

where, a content (mass %) of a corresponding element is substituted for each symbol of an element in Formula (1).

Advantageous Effects of Invention

The seamless steel pipe according to the present disclosure has a yield strength within a range of 758 to 862 MPa (110 ksi grade) and has excellent HIC resistance.

DESCRIPTION OF EMBODIMENTS

Figure 1:
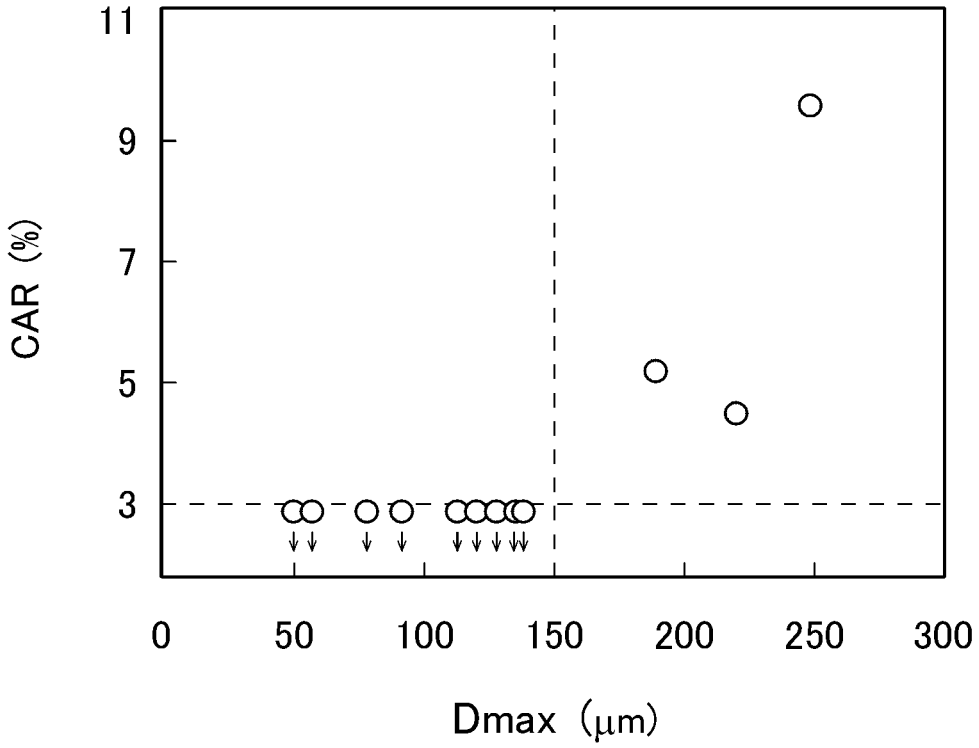
FIG. 1 is a view illustrating the relation between a predicted maximum major axis of inclusions and HIC resistance.

The present inventors conducted investigations and studies regarding HIC resistance in seamless steel pipes having a yield strength within a range of 758 to 862 MPa (110 ksi grade) that will assumedly be used in a sour environment, and obtained the following findings.

First, the present inventors thought of raising the yield strength of a seamless steel pipe to 110 ksi grade by adjusting the chemical composition so as to consist of, in mass %. C: 0.15 to 0.45%, Si: 0.05 to 1.00%, Mn: 0.01 to 1.00%, P: 0.030% or less, S: 0.0050% or less, Al: 0.005 to 0.070%, Cr: 0.30 to 1.50%, Mo: 0.25 to 2.00%, Ti: 0.002 to 0.020%, Nb: 0.002 to 0.100%, B: 0.0005 to 0.0040%, rare earth metal: 0.0001 to 0.0015%, Ca: 0.0001 to 0.0100%, N: 0.0100% or less, O: 0.0020% or less, V: 0 to 0.30%, Mg: 0 to 0.0100%, Zr: 0 to 0.0100%, Co: 0 to 1.00%, W: 0 to 1.00%, Ni: 0 to 0.50% and Cu: 0 to 0.50%, with the balance being Fe and impurities. The present inventors then produced various kinds of seamless steel pipes of 110 ksi grade having the aforementioned chemical composition, and investigated and studied the HIC resistance of the seamless steel pipes.

The occurrence of HIC was confirmed in some seamless steel pipes among the seamless steel pipes having the aforementioned chemical composition and having a yield strength of 110 ksi grade. Therefore, the present inventors conducted detailed investigations regarding the seamless steel pipes in which HIC had occurred. As a result, the present inventors found that, in the seamless steel pipes in which HIC had occurred, cracking had occurred that originated from coarse inclusions as starting points.

The present inventors then performed detailed studies regarding the relation between coarse inclusions and HIC resistance. As a result, the present inventors obtained the following finding. That is, when coarse inclusions are present in a seamless steel pipe, stress concentration is liable to occur at the interface between the inclusions and the base metal. In such a case, HIC occurs that originates from the inclusions as starting points. In addition, among coarse inclusions, stress concentration is liable to occur at the interface between, in particular, inclusions that have a long major axis and the base metal. Therefore, in a case where inclusions that have a long major axis are present in a seamless steel pipe, the HIC resistance of the seamless steel pipe decreases. That is, in order to increase the HIC resistance of a seamless steel pipe, it is good to reduce inclusions that have a long major axis, and not simply to reduce coarse inclusions.

As the result of further studies conducted by the present inventors, the present inventors clarified that among inclusions contained in a seamless steel pipe, fine inclusions do not lower HIC resistance. That is, it is considered that in order to increase the HIC resistance of a seamless steel pipe, requirements that suit the actual situation can be set if a determination as to whether or not inclusions that have a long major axis are present in the seamless steel pipe can be used as an index, and not by using as an index a mean value of inclusions, such as the mean grain size of inclusions.

On the other hand, conventionally, the grain size of inclusions that is obtained by microscope observation (for example, equivalent circular diameter or square root of the area) or the major axis of inclusions has been used as an index of the coarseness of inclusions. In the conventional microscope observation, although inclusions contained in a seamless steel pipe can be observed, such microscope observation is little more than observation of an average distribution of inclusions, such as the number density in several visual fields. Further, in the conventional microscope observation, in order to determine whether or not inclusions that have a long major axis are present, it is necessary to increase the number of visual fields for the microscope observation and to widen the visual field area. However, if the number of visual fields for microscope observation is increased without careful consideration, the time and expense required to perform the microscope observation will increase.

Therefore, the present inventors conceived of using statistical processing to predict the major axis of inclusions contained in a seamless steel pipe. Specifically, the present inventors focused their attention on a technique referred to as "extreme value statistical processing". The term "extreme value statistical processing" refers to a technique that acquires an extreme value (for example, a maximum major axis of inclusions) in respective visual fields, and estimates the probability distribution in a plurality of visual fields. By using extreme value statistical processing, the maximum major axis of inclusions that are present in a seamless steel pipe can be predicted. Therefore, the present inventors investigated the relation between the maximum major axis of inclusions contained in a seamless steel pipe that is predicted by extreme value statistical processing (hereunder also referred to simply as "predicted maximum major axis of inclusions") and HIC resistance.

Specifically, the present inventors investigated in detail the relation between a predicted maximum major axis of inclusions (Dmax) determined by extreme value statistical processing that is described later and HIC resistance in seamless steel pipes having the aforementioned chemical composition and having a yield strength of 110 ksi grade. FIG. 1 is a view that illustrates the relation between the predicted maximum major axis of inclusions and HIC resistance. FIG. 1 was created using a predicted maximum major axis of inclusions Dmax (μm) obtained by a method that is described later and a cracking area ratio CAR (%) obtained by an HIC test that is described later, with respect to seamless steel pipes for which, among the seamless steel pipes of the examples that are described later, having the aforementioned chemical composition and having a yield strength of 110 ksi grade.

Note that, adjustment of the yield strength of each seamless steel pipe shown in FIG. 1 was performed by adjusting the tempering temperature. Further, regarding HIC resistance, the HIC resistance was determined as being good if the cracking area ratio CAR was less than 3.0%. The down arrow in FIG. 1 denotes that the cracking area ratio CAR is lower than the illustrated plot position.

Referring to FIG. 1, in the seamless steel pipes satisfying the aforementioned chemical composition and having a yield strength of 110 ksi grade, when the predicted maximum major axis of inclusions Dmax is more than 150 μm, the cracking area ratio CAR is 3.0% or more and the HIC resistance decreases. On the other hand, when the predicted maximum major axis of inclusions Dmax is 150 μm or less, the cracking area ratio CAR is less than 3.0% and the HIC resistance increases. That is, in FIG. 1, as the result of detailed studies conducted by the present inventors, the present inventors clarified when the predicted maximum major axis of inclusions Dmax is 150 μm or less, the HIC resistance can be remarkably increased.

Therefore, referring to FIG. 1, it was clarified as a result of the studies conducted by the present inventors that in a seamless steel pipe satisfying the aforementioned chemical composition and having a yield strength of 110 ksi grade, if the predicted maximum major axis of inclusions Dmax is 150 μm or less, there is the remarkable advantageous effect that the cracking area ratio CAR is less than 3.0%. Accordingly, in the seamless steel pipe according to the present embodiment, the aforementioned chemical composition is satisfied, the yield strength is of 110 ksi grade, and the predicted maximum major axis of inclusions Dmax is 150 μm or less. As a result, the seamless steel pipe according to the present embodiment exhibits excellent HIC resistance, with the cracking area ratio CAR being less than 3.0%.

The seamless steel pipe according to the present embodiment that was completed based on the above findings has a chemical composition consisting of, in mass %, C: 0.15 to 0.45%, Si: 0.05 to 1.00%, Mn: 0.01 to 1.00%, P: 0.030% or less, S: 0.0050% or less, Al: 0.005 to 0.070%, Cr: 0.30 to 1.50%, Mo: 0.25 to 2.00%, Ti: 0.002 to 0.020%, Nb: 0.002 to 0.100%, B: 0.0005 to 0.0040%, rare earth metal: 0.0001 to 0.0015%, Ca: 0.0001 to 0.0100%, N: 0.0100% or less, O: 0.0020% or less, V: 0 to 0.30%, Mg: 0 to 0.0100%, Zr: 0 to 0.0100%, Co: 0 to 1.00%, W: 0 to 1.00%, Ni: 0 to 0.50% and Cu: 0 to 0.50%, with the balance being Fe and impurities, and satisfying Formula (1). In the seamless steel pipe according to the present embodiment, a maximum major axis of inclusions in the seamless steel pipe is 150 μm or less, the maximum major axis being predicted by means of extreme value statistical processing. In the seamless steel pipe according to the present embodiment, the yield strength is within a range of 758 to 862 MPa.

$$(Ca/O+Ca/S+0.285\times REM/O+0.285\times REM/S)\times(Al/Ca) \geq 40.0 \quad (1)$$

where, a content (mass %) of the corresponding element is substituted for each symbol of an element in Formula (1).

The aforementioned chemical composition may contain V in an amount of 0.01 to 0.30%.

The aforementioned chemical composition may contain one or more types of element selected from the group consisting of Mg: 0.0001 to 0.0100% and Zr: 0.0001 to 0.0100%.

The aforementioned chemical composition may contain one or more types of element selected from the group consisting of Co: 0.02 to 1.00% and W: 0.02 to 1.00%.

The aforementioned chemical composition may contain one or more types of element selected from a group consisting of Ni: 0.01 to 0.50% and Cu: 0.01 to 0.50%.

The aforementioned seamless steel pipe may be an oil-well steel pipe.

In the present description, the oil-well steel pipe may be oil country tubular goods. The oil country tubular goods are, for example, steel pipes that are used for use in casing or tubing.

If the seamless steel pipe according to the present embodiment is an oil-well steel pipe, even when the wall thickness thereof is 15 mm or more, the seamless steel pipe has a yield strength of 758 to 862 MPa 010 ksi grade) and has excellent HIC resistance in a sour environment, The excellent HIC resistance in a sour environment that is mentioned above can be evaluated by a method in accordance with NACE TM0284-2011. Specifically, the HIC resistance can be evaluated by the following method. A mixed aqueous solution containing 5.0 mass % of sodium chloride and 0.5 mass % of acetic acid (NACE solution A) is employed as the test solution.

A test specimen prepared from the seamless steel pipe is immersed in the test solution at 24° C. After the test solution is degassed, $H_2S$ at 1 atm is sealed therein, and this is adopted as a test bath. After being held for 96 hours while stirring the test bath, the test specimen is taken out. The test specimen that was taken out is subjected to an ultrasonic flaw detection test (C-scan), and the area of indication portions (HIC occurrence portions) is determined.

The cracking area ratio CAR (%) is obtained from the following Formula (2) based on the determined area of indication portions and the projected area of the test specimen during the ultrasonic flaw detection test.

$$CAR\ (\%)=(\text{area of indication portions}/\text{projected area})\times 100 \quad (2)$$

For the seamless steel pipe according to the present embodiment, in the HIC resistance test, the cracking area ratio CAR (%) after 96 hours elapsed is less than 3.0%.

Hereunder, the seamless steel pipe according to the present invention is described in detail. The symbol "%" in relation to an element means "mass percent" unless specifically stated otherwise.

[Chemical Composition]

The chemical composition of the seamless steel pipe according to the present invention contains the following elements.

C: 0.15 to 0.45%

Carbon (C) enhances the hardenability of the steel material and increases the yield strength of the steel material. C also promotes spheroidization of carbides during tempering in the production process, and further increases the yield strength of the steel material. These effects will not be obtained if the C content is too low. On the other hand, if the C content is too high, the toughness of the steel material will decrease and quench cracking is liable to occur. Therefore, the C content is within the range of 0.15 to 0.45%. A preferable lower limit of the C content is 0.18%, more preferably is 0.20%, further preferably is 0.22%, and further preferably is 0.24%. A preferable upper limit of the C content is 0.40%, more preferably is 0.35%, further preferably is 0.33%, and further preferably is 0.30%.

Si: 0.05 to 1.00%

Silicon (Si) deoxidizes steel. If the Si content is too low, this effect is not obtained. On the other hand, if the Si content is too high, the SSC resistance of the steel material decreases. Therefore, the Si content is within the range of 0.05 to 1.00%. A preferable lower limit of the Si content is 0.15%, and more preferably is 0.20%. A preferable upper limit of the Si content is 0.85%, more preferably is 0.70%, further preferably is 0.60%, further preferably is 0.50%, further preferably is 0.45%, and further preferably is 0.40%.

Mn: 0.01 to 1.00%

Manganese (Mn) deoxidizes steel. Mn also enhances the hardenability of the steel material, and increases the yield strength of the steel material. If the Mn content is too low, these effects are not obtained. On the other hand, if the Mn content is too high, Mn segregates at grain boundaries together with impurities such as P and S. As a result, the HIC resistance of the steel material decreases. Furthermore, if the Mn content is too high, the amount of MnS, which is an inclusion that easily extends, increases. As a result, the predicted maximum major axis of inclusions becomes longer, and the HIC resistance of the steel material decreases. Therefore, the Mn content is within a range of 0.01 to 1.00%. A preferable lower limit of the Mn content is 0.02%, and more preferably is 0.03%. A preferable upper limit of the Mn content is 0.90%, more preferably is 0.80%, further preferably is 0.70%, further preferably is 0.60%, further preferably is 0.55%, and further preferably is 0.50%.

P: 0.030% or less

Phosphorous (P) is an impurity. That is, the P content is more than 0%. P segregates at the grain boundaries and embrittles the steel material. As a result, the HIC resistance of the steel material decreases. Therefore, the P content is 0.030% or less. A preferable upper limit of the P content is 0.025%, and more preferably is 0.020%. Preferably, the P content is as low as possible. However, if the P content is excessively reduced, the production cost increases significantly. Therefore, when taking industrial production into consideration, a preferable lower limit of the P content is 0.0001%, more preferably is 0.0003%, further preferably is 0.001%, and further preferably is 0.002%.

S: 0.0050% or less

Sulfur (S) is an impurity. That is, the S content is more than 0%. S segregates at the grain boundaries and embrittles the steel material. As a result, the HIC resistance of the steel material decreases. S also combines with Mn to form MnS. MnS is an inclusion that easily extends, and if the amount of MnS increases, the predicted maximum major axis of inclusions becomes longer. As a result, the HIC resistance of the steel material decreases. Therefore, the S content is 0.0050% or less. A preferable upper limit of the S content is 0.0045%, more preferably is 0.0035%, further preferably is 0.0030%, and further preferably is 0.0025%. Preferably, the S content is as low as possible. However, if the S content is excessively reduced, the production cost increases significantly. Therefore, when taking industrial production into consideration, a preferable lower limit of the S content is 0.0001%, and more preferably is 0.0003%.

Al: 0.005 to 0.070%

Aluminum (Al) deoxidizes steel. If the Al content is too low, this effect is not obtained. On the other hand, if the Al content is too high, coarse inclusions are formed in the steel material, and the predicted maximum major axis of inclusions becomes longer. As a result, the HIC resistance of the steel material decreases. Therefore, the Al content is within a range of 0.005 to 0.070%. A preferable lower limit of the Al content is 0.010%, and more preferably is 0.015%. A preferable upper limit of the Al content is 0.060%, more preferably is 0.050%, further preferably is 0.045%, further preferably is 0.040%, and further preferably is 0.035%. In the present description, the "Al" content means "acid-soluble Al", that is, the content of "sol. Al".

Cr: 0.30 to 1.50%

Chromium (Cr) enhances the hardenability of the steel material and increases the yield strength of the steel material. If the Cr content is too low, this effect is not obtained. On the other hand, if the Cr content is too high, coarse carbides form in the steel material and the SSC resistance of the steel material decreases. Therefore, the Cr content is within a range of 0.30 to 1.50%, A preferable lower limit of the Cr content is 0.32%, more preferably is 0.35%, further preferably is 0.40%, further preferably is 0.45%, and further preferably is 0.50%. A preferable upper limit of the Cr content is 1.40%, more preferably is 1.30%, further preferably is 1.25%, and further preferably is 1.10%.

Mo: 0.25 to 2.00%

Molybdenum (Mo) enhances the hardenability of the steel material and increases the yield strength of the steel material. If the Mo content is too low, this effect is not obtained. On the other hand, if the Mo content is too high, the aforementioned effects are saturated. Therefore, the Mo content is within a range of 0.25 to 2.00%. A preferable lower limit of the Mo content is 0.30%, more preferably is 0.40%, further preferably is 0.45%, further preferably is 0.50%, further preferably is 0.55%, and further preferably is 0.60%. A preferable upper limit of the Mo content is 1.70%, more preferably is 1.50%, further preferably is 1.40%, and further preferably is 1.30%.

Ti: 0.002 to 0.020%

Titanium (Ti) combines with N to form fine nitrides, and refines the crystal grains by the pinning effect. As a result, the yield strength of the steel material increases. If the Ti content is too low, this effect is not obtained. On the other hand, if the Ti content is too high, coarse Ti nitrides are formed in the steel material, and the HIC resistance of the steel material decreases. Therefore, the Ti content is within a range of 0.002 to 0.020%. A preferable lower limit of the Ti content is 0.003%, and more preferably is 0.004%. A preferable upper limit of the Ti content is 0.018%, more preferably is 0.015%, further preferably is 0.012%, and further preferably is 0.010%.

Nb: 0.002 to 0.100%

Niobium (Nb) combines with C to form fine carbides. As a result, the yield strength of the steel material increases. This effect is not obtained if the Nb content is too low. On the other hand, if the Nb content is too high, carbides, nitrides or carbo-nitrides (hereinafter, referred to as "carbo-nitrides and the like") are excessively formed in some cases. In such cases, the HIC resistance of the steel material decreases. Therefore, the Nb content is within the range of 0.002 to 0.100%. A preferable lower limit of the Nb content is 0.003%, more preferably 0.007%, further preferably is 0.010%, further preferably is 0.015%, and further preferably is 0.020%. A preferable upper limit of the Nb content is 0.080%, more preferably is 0.050%, further preferably is 0.040%, and further preferably is 0.030%.

B: 0.0005 to 0.0040%

Boron (B) dissolves in the steel and enhances the hardenability of the steel material, and increases the yield strength of the steel material. If the B content is too low, this effect is not obtained. On the other hand, if the B content is too high, coarse B nitrides are formed and the HIC resistance of the steel material decreases. Therefore, the B content is within a range of 0.0005 to 0.0040%. A preferable lower limit of the B content is 0.0008%, and more preferably is 0.0010%. A preferable upper limit of the B content is 0.0030%, more preferably is 0.0025%, further preferably is 0.0020%, further preferably is 0.0018%, and further preferably is 0.0015%.

Rare earth metal: 0.0001 to 0.0015%

Rare earth metal (REM) reduces FeO. As a result, REM suppresses the formation of $Al_2O_3$ clusters, and $Al_2O_3$, $X_2O_3$ and $X_2OS$ (X represents REM) are formed. As a result, the predicted maximum major axis of inclusions decreases, and the HIC resistance of the steel material increases. REM also combines with P in the steel material and suppresses segregation of P at the crystal grain boundaries. As a result, the HIC resistance of the steel material increases. These effects are not obtained if the REM content is too low. On the other hand, if the REM content is too high, coarse inclusions are formed in the steel material, and the predicted maximum major axis of inclusions becomes longer. As a result, the HIC resistance of the steel material decreases. Therefore, the REM content is within the range of 0.0001 to 0.0015%. A preferable lower limit of the REM content is 0.0002%, more preferably is 0.0003%, further preferably is 0.0004%, further preferably is 0.0005%, and further preferably is 0.0006%. A preferable upper limit of the REM content is 0.0012%, more preferably is 0.0011%, further preferably is 0.0010%, and further preferably is 0.0009%.

Note that, in the present description the term "REM" refers to one or more types of element selected from a group consisting of scandium (Sc) which is the element with atomic number 21, yttrium (Y) which is the element with atomic number 39, and the elements from lanthanum (La) with atomic number 57 to lutetium (Lu) with atomic number 71 that are lanthanoids. Further, in the present description the term "REM content" refers to the total content of these elements.

Ca: 0.0001 to 0.0100%

Calcium (Ca) spheroidizes inclusions contained in the steel material and decreases the predicted maximum major axis of inclusions. As a result, the HIC resistance of the steel material increases. This effect is not obtained if the Ca content is too low. On the other hand, if the Ca content is too high, coarse oxide-based inclusions are formed in the steel material, and the HIC resistance of the steel material decreases. Therefore, the Ca content is within the range of 0.0001 to 0.0100%. A preferable lower limit of the Ca content is 0.0002%, more preferably is 0.0003%, further preferably is 0.0005%, further preferably is 0.0006%, further preferably is 0.0008%, and further preferably is 0.0010%. A preferable upper limit of the Ca content is 0.0040%, more preferably is 0.0030%, further preferably is 0.0025%, further preferably is 0.0020%, further preferably is 0.0017%, and further preferably is 0.0015%.

N: 0.0100% or less

Nitrogen (N) is unavoidably contained. That is, the N content is more than 0%. N combines with Ti to form fine nitrides, and refines the crystal grains by the pinning effect. As a result, the yield strength of the steel material increases. On the other hand, if the N content is too high, coarse Ti nitrides are formed in the steel material, and the HIC resistance of the steel material decreases. Therefore, the N content is 0.0100% or less. A preferable upper limit of the N content is 0.0050%, and more preferably is 0.0045%. A preferable lower limit of the N content for more effectively obtaining the aforementioned effect is 0.0015%, more preferably is 0.0020%, further preferably is 0.0025%, and further preferably is 0.0030%.

O: 0.0020% or less

Oxygen (O) is an impurity. That is, the O content is more than 0%. O forms coarse oxide-based inclusions, and makes the predicted maximum major axis of inclusions longer. As a result, the HIC resistance of the steel material decreases. Therefore, the O content is 0.0020% or less. A preferable upper limit of the O content is 0.0019%, more preferably is 0.0018%, further preferably is 0.0016%, and further preferably is 0.0015%. Preferably, the O content is as low as possible. However, if the O content is excessively reduced, the production cost increases significantly. Therefore, when taking industrial production into consideration, a preferable lower limit of the O content is 0.0001%, and more preferably is 0.0003%.

The balance of the chemical composition of the steel material according to the present embodiment is Fe and impurities. Here, the term "impurities" refers to elements which, during industrial production of the steel material, are mixed in from ore or scrap that is used as a raw material of the steel material, or from the production environment or the like, and which are allowed within a range that does not adversely affect the steel material according to the present embodiment.

[Regarding Optional Elements]

The chemical composition of the steel material described above may further contain V in lieu of a part of Fe.

V: 0 to 0.30%

Vanadium (V) is an optional element, and need not be contained. That is, the V content may be 0%. If contained, V forms fine carbides during tempering, and increases the yield strength of the steel material. If even a small amount of V is contained, this effect is obtained to a certain extent. However, if the V content is too high, the toughness of the steel material decreases. Therefore, the V content is within the range of 0 to 0.30%. A preferable lower limit of the V content is more than 0%, more preferably is 0.01%, further preferably is 0.02%, further preferably is 0.04%, further preferably is 0.06%, and further preferably is 0.08%. A preferable upper limit of the V content is 0.25%, more preferably is 0.20%, further preferably is 0.15%, and further preferably is 0.12%.

The chemical composition of the steel material described above may further contain one or more types of element selected from the group consisting of Mg and Zr in lieu of a part of Fe. Each of these elements is an optional element, and increases the HIC resistance of the steel material.

Mg: 0 to 0.0100%

Magnesium (Mg) is an optional element, and need not be contained. That is, the Mg content may be 0%. If contained, Mg refines sulfide-based inclusions contained in the steel material, and makes the predicted maximum major axis of inclusions shorter. As a result, the HIC resistance of the steel material increases. If even a small amount of Mg is contained, this effect is obtained to a certain extent. However, if the Mg content is too high, coarse inclusions are formed in the steel material, and the predicted maximum major axis of inclusions becomes longer. As a result, the HIC resistance of the steel material decreases. Therefore, the Mg content is within the range of 0 to 0.0100%. A preferable lower limit of the Mg content is more than 0%, more preferably is 0.0001%, further preferably is 0.0003%, further preferably is 0.0006%, and further preferably is 0.0010%. A preferable upper limit of the Mg content is 0.0040%, more preferably is 0.0030%, further preferably is 0.0025%, and further preferably is 0.0020%.

Zr: 0 to 0.0100%

Zirconium (Zr) is an optional element, and need not be contained. That is, the Zr content may be 0%. If contained, Zr refines sulfide-based inclusions contained in the steel material, and makes the predicted maximum major axis of inclusions shorter. As a result, the HIC resistance of the steel material increases. If even a small amount of Zr is contained, this effect is obtained to a certain extent. However, if the Zr content is too high, coarse inclusions are formed in the steel material, and the predicted maximum major axis of inclusions becomes longer. As a result, the HIC resistance of the steel material decreases. Therefore, the Zr content is within the range of 0 to 0.0100%. A preferable lower limit of the Zr content is more than 0%, more preferably is 0.0001%, further preferably is 0.0003%, further preferably is 0.0006%, and further preferably is 0.0010%. A preferable upper limit of the Zr content is 0.0040%, more preferably is 0.0030%, further preferably is 0.0025%, and further preferably is 0.0020%.

The chemical composition of the steel material described above may further contain one or more types of element selected from the group consisting of Co and W in lieu of a part of Fe. Each of these elements is an optional element that forms a protective corrosion coating in a sour environment and suppresses hydrogen penetration. By this means, each of these elements increases the HIC resistance of the steel material.

Co: 0 to 1.00%

Cobalt (Co) is an optional element, and need not be contained. That is, the Co content may be 0%, if contained, Co forms a protective corrosion coating in a sour environment and suppresses hydrogen penetration. As a result, Co increases the HIC resistance of the steel material. If even a small amount of Co is contained, this effect is obtained to a certain extent. However, if the Co content is too high, the hardenability of the steel material will decrease, and the yield strength of the steel material will decrease. Therefore, the Co content is within the range of 0 to 1.00%. A preferable lower limit of the Co content is more than 0%, more preferably is 0.02%, further preferably is 0.03%, and further preferably is 0.05%. A preferable upper limit of the Co content is 0.90%, and more preferably is 0.80%.

W: 0 to 1.00%

Tungsten (W) is an optional element, and need not be contained. That is, the W content may be 0%. If contained, W forms a protective corrosion coating in a sour environment and suppresses hydrogen penetration. As a result, W increases the HIC resistance of the steel material. If even a small amount of W is contained, this effect is obtained to a certain extent. However, if the W content is too high, coarse carbides form in the steel material and embrittle the steel material. As a result, the HIC resistance of the steel material decreases. Therefore, the W content is within the range of 0 to 1.00%. A preferable lower limit of the W content is more than 0%, more preferably is 0.02%, further preferably is 0.03%, and further preferably is 0.05%. A preferable upper limit of the W content is 0.90%, and more preferably is 0.80%.

The chemical composition of the steel material described above may further contain one or more types of element selected from the group consisting of Ni and Cu in lieu of a part of Fe. Each of these elements is an optional element, enhances the hardenability of the steel material, and increases the yield strength of the steel material.

Ni: 0 to 0.50%

Nickel (Ni) is an optional element, and need not be contained. That is, the Ni content may be 0%. If contained, Ni enhances the hardenability of the steel material and increases the yield strength of the steel material. If even a small amount of Ni is contained, this effect is obtained to a certain extent. However, if the Ni content is too high, the Ni will promote local corrosion, and the SSC resistance of the steel material will decrease. Therefore, the Ni content is within the range of 0 to 0.50%. A preferable lower limit of the Ni content is more than 0%, more preferably is 0.01%, and further preferably is 0.02%. A preferable upper limit of the Ni content is 0.10%, more preferably is 0.08%, and further preferably is 0.06%.

Cu: 0 to 0.50%

Copper (Cu) is an optional element, and need not be contained. That is, the Cu content may be 0%. If contained, Cu enhances the hardenability of the steel material and increases the yield strength of the steel material. If even a small amount of Cu is contained, this effect is obtained to a certain extent. However, if the Cu content is too high, the hardenability of the steel material will be too high, and the toughness of the steel material will decrease. Therefore, the Cu content is within the range of 0 to 0.50%. A preferable lower limit of the Cu content is more than 0%, more preferably is 0.01%, further preferably is 0.02%, and further preferably is 0.05%. A preferable upper limit of the Cu content is 0.35%, and more preferably is 0.25%.

[Regarding Formula (1)]

The chemical composition of the seamless steel pipe according to the present embodiment also satisfies Formula (1).

$$(Ca/O+Ca/S+0.285\times REM/O+0.285\times REM/S)\times (Al/Ca)\geq 40.0 \quad (1)$$

where, a content (mass %) of a corresponding element is substituted for each symbol of an element in Formula (1).

Fn1(=(Ca/O+Ca/S+0.285×REM/O+0.285×REM/S)×(Al/Ca)) is an index that indicates the shape of inclusions produced by Ca and REM in a seamless steel pipe that has the aforementioned chemical composition and has a yield strength of 110 ksi grade. The value "0.285" of Fn1 is a coefficient in a case where the REM content is converted to a Ca content by an approximate calculation. In Fn1, "Ca/O+Ca/S+0.285×REM/O+0.285×REM/S" is the sum of the ratios of the Ca content to O and S that are obtained when the REM content is converted to a Ca content. "Al/Ca" in Fn1 is an index of the melting point of inclusions.

If Fn1 is too small, inclusions are liable to extend. Therefore, Fn1 is 40.0 or more. A preferable lower limit of Fn1 is 41.0, and more preferably is 42.0. A preferable upper limit of Fn1 is 140.0, and more preferably is 130.0.

[Regarding Predicted Maximum Major Axis of Inclusions]

In the seamless steel pipe according to the present embodiment, a maximum major axis (predicted maximum major axis of inclusions) Dmax of inclusions contained in the seamless steel pipe is 150 μm or less, the maximum major axis being predicted by means of extreme value statistical processing. If the predicted maximum major axis of inclusions Dmax is more than 150 μm, the CAR of the seamless steel pipe will be 3.0% or more, and the HIC resistance of the seamless steel pipe will decrease. Therefore, the predicted maximum major axis of inclusions Dmax is 150 μm or less.

A preferable upper limit of the predicted maximum major axis of inclusions Dmax is 148 μm, and more preferably is 145 μm. The predicted maximum major axis of inclusions Dmax is preferably as small as possible.

The predicted maximum major axis of inclusions Dmax can be determined by the following method. A test specimen having an observation surface with dimensions of 10 mm in the pipe axis direction and 10 mm in the pipe radial direction is cut out from a center portion of the wall thickness of the seamless steel pipe according to the present embodiment. In addition, in a case where the wall thickness of the seamless steel pipe is less than 10 mm, a test specimen having an observation surface with dimensions of 10 mm in the pipe axis direction and a wall thickness of the seamless steel pipe in the pipe radial direction is cut out. After polishing the observation surface of the test specimen to obtain a mirror surface, the observation surface is observed by performing observation with respect to n visual fields ("n" represents a natural number) by means of a secondary electron image obtained using a scanning electron microscope (SEM).

In this case, if the number of observation visual fields n is too small, accuracy may not be obtained in the extreme value statistical processing in some cases. Therefore, in the extreme value statistical processing according to the present embodiment, the number of observation visual fields n is 20 or more. The number of observation visual fields n is, for example, 108. Further, if the gross area of the observation visual fields (hereunder, also referred to as "reference area S0") is too narrow, accuracy may not be obtained in the extreme value statistical processing in some cases. Therefore, in the extreme value statistical processing according to the present embodiment, the reference area S0 is 20 $mm^2$ or more. The reference area S0 is, for example, 196.5 $mm^2$.

A maximum major axis Lmax of inclusions in each visual field is determined, respectively. The maximum major axis Lmax of inclusions in each visual field can be determined by image analysis of an observation image. Note that, in a case where the shortest distance between the plurality of inclusions is 40 μm or less in the pipe axis direction and 15 μm or less in the pipe radial direction, these inclusions are rewarded as one inclusion. This will be described with reference to the drawing.

Figure 2:
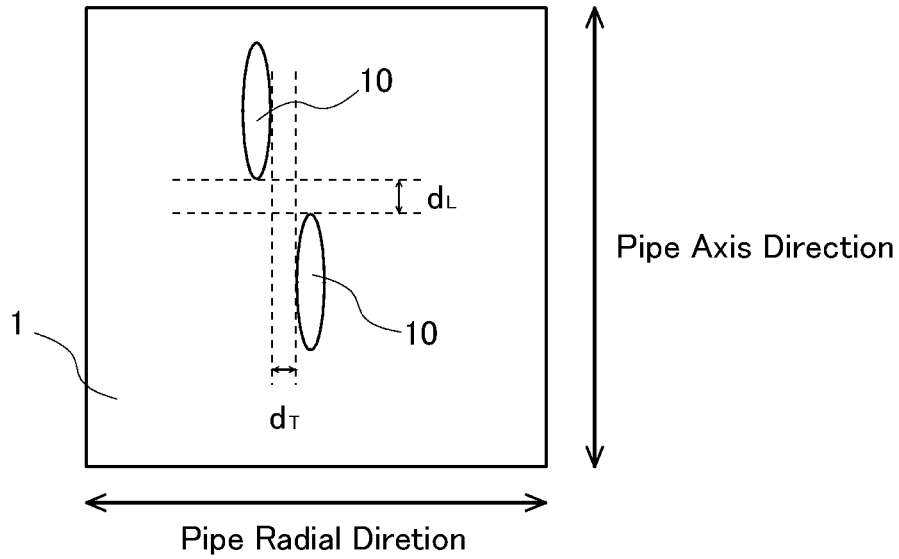
FIG. 2 is a schematic diagram indicating the distribution of inclusions in the observation visual field when obtaining the predicted maximum major axis of inclusions according to the present embodiment.

FIG. 2 is a schematic diagram indicating the distribution of inclusions in the observation visual field 1 when obtaining the predicted maximum major axis of inclusions according to the present embodiment. FIG. 2 is a diagram for describing whether two inclusions are regarded as one inclusion or not. The vertical direction in FIG. 2 corresponds to the pipe axis direction. The lateral direction in FIG. 2 corresponds to the pipe radial direction. Reference numeral 10 in FIG. 2 denotes the inclusions in the observation visual field 1. Referring to FIG. 2, the shortest distance in the pipe axis direction between the inclusions 10 is $d_L$, and the shortest distance in the pipe radial direction between the inclusions 10 is $d_T$. In a case where the shortest distance in the pipe axis direction $d_L$ is 40 μm or less and the shortest distance in the pipe radial direction $d_T$ is 15 μm or less, these inclusions 10 are regarded as one inclusion. On the other hand, in a case where the shortest distance in the pipe axis direction $d_L$ is more than 40 μm, these inclusions 10 are regarded as distinct inclusions respectively. Further, in a case where the shortest distance in the pipe radial direction $d_T$ is more than 15 μm, these inclusions 10 are also regarded as distinct inclusions respectively.

Note that, the same determination is performed as to whether three or more inclusions are regarded as one inclusion or not. In this case, at first, it is determined as described above whether two adjacent inclusions are regarded as one inclusion or not. In a case where two adjacent inclusions are regarded as one inclusion, the shortest distance between the inclusion regarded as one inclusion and further adjacent inclusion is 40 μm or less in the pipe axis direction and 15 μm or less in the pipe radial direction, these three or more inclusions are regarded as one inclusion. As described above, whether three or more inclusions are regarded as one inclusion or not can be determined by continuously applying the above described method.

The maximum major axis Lmax of the respective visual fields that are determined are defined as Lmaxj (j=1 to n) in the order from the smallest value. That is, the maximum major axes of the inclusions of the respective visual fields are assigned numbers in a manner such that Lmax1≤Lmax2≤Lmax3≤ . . . ≤Lmaxn.

Next, using Formulae (3) and (4) below, a cumulative distribution function Fj and a standardized variable yj are determined for each j value.

$$Fj=j/(n+1) \tag{3}$$

$$yj=-\ln\{-\ln(Fj)\} \tag{4}$$

Note that, "ln" in Formula (4) means a natural logarithm.

A plot of the standardized variable yj (j=1 to n) with respect to the maximum major axis Lmaxj (j=1 to n) is created. With regard to the created plot, an approximation straight line (maximum inclusion distribution straight line) is created by the least-squares method. The created approximation straight line can be expressed by the following Formula (5).

$$yj=c\times Lmaxj+d \tag{5}$$

where, c and d are coefficients of a straight line determined by the least-squares method.

Next, a recurrence period T is determined using the following Formula (6).

$$T=(S+S0)/S0 \tag{6}$$

where, S represents a virtual surface area ($mm^2$) at the center portion of the wall thickness of the seamless steel pipe. Specifically, S can be determined by the following Formula (7).

$$S=(R-t)\times\pi\times L \quad (7)$$

where, R represents the outer diameter (mm) of the seamless steel pipe, t represents the wall thickness (mm) of the seamless steel pipe, and L represents the length (mm) in the axial direction of the seamless steel pipe.

A predicted standardized variable y is determined using the determined recurrence period T and Formula (8).

$$y=-\ln\{-\ln((T-1)/T)\} \quad (8)$$

Note that, "ln" in Formula (8) represents a natural logarithm, similarly to Formula (4).

Based on the predicted standardized variable y that is determined and Formula (5), Lmax with respect to the predicted standardized variable y is determined. The thus-determined Lmax is defined as the predicted maximum major axis of inclusions Dmax (μm).

[Regarding Microstructure]

The microstructure of the seamless steel pipe according to the present embodiment is principally composed of tempered martensite and tempered bainite. Specifically, the total of the volume ratios of tempered martensite and tempered bainite in the microstructure is 90% or more. The balance of the microstructure is, for example, ferrite or pearlite. If the microstructure of the seamless steel pipe having the aforementioned chemical composition contains tempered martensite and tempered bainite in an amount equivalent to a total volume ratio of 90% or more, on the condition that the other requirements according to the present embodiment are satisfied, the yield strength of the seamless steel pipe will be in the range of 758 to 862 MPa (110 ksi grade), and further, the yield ratio of the seamless steel pipe will be 90.0% or more.

The total volume ratio of tempered martensite and tempered bainite can be determined by microstructure observation. A test specimen having an observation surface with dimensions of 10 mm in the pipe axis direction and 10 mm in the pipe radial direction is cut out from a center portion of the wall thickness of the seamless steel pipe according to the present embodiment. In addition, in a case where the wall thickness of the seamless steel pipe is less than 10 mm, a test specimen having an observation surface with dimensions of 10 mm in the pipe axis direction and a wall thickness of the seamless steel pipe in the pipe radial direction is cut out. After polishing the observation surface to obtain a mirror surface, the small piece is immersed for about 10 seconds in a 2% vital etching reagent, to reveal the microstructure by etching. The etched observation surface is observed by performing observation with respect to 10 visual fields by means of a secondary electron image obtained using a scanning electron microscope (SEM). The visual field area is 400 $\mu m^2$ (magnification of ×5000).

In each visual field, tempered martensite and tempered bainite can be distinguished from other phases (ferrite or pearlite) based on contrast. Accordingly, tempered martensite and tempered bainite are identified in each visual field. The totals of the area ratio of the identified tempered martensite and tempered bainite are determined. In the present embodiment, the arithmetic average value of the totals of the area ratio of tempered martensite and tempered bainite determined in all of the visual fields is defined as the volume ratio of tempered martensite and tempered bainite.

[Uses of Seamless Steel Pipe]

In a case where the seamless steel pipe according to the present embodiment is an oil-well steel pipes, a preferable wall thickness is in the range of 9 to 60 mm. More preferably, the seamless steel pipe according to the present embodiment is suitable for use as a heavy-wall oil-well steel pipe. More specifically, even if the seamless steel pipe according to the present embodiment is an oil-well steel pipe having a thick wall with a thickness of 15 mm or more or, furthermore, 20 mm or more, a yield strength within the range of 758 to 862 MPa (110 ksi grade) is obtained and excellent HIC resistance is exhibited.

[Regarding Yield Strength and Yield Ratio]

The yield strength of the seamless steel pipe according to the present embodiment is within the range of 758 to 862 MPa (110 ksi grade). As used in the present description, a "yield strength" means stress at a time of 0.7% total elongation (0.7% proof stress) obtained in a tensile test. In short, the yield strength of the seamless steel pipe according to the present embodiment is of 110 ksi grade.

In the seamless steel pipe according to the present embodiment, the yield ratio (YR) is 90.0% or more. A "yield ratio" means a ratio of the yield strength (YS) to the tensile strength (TS) (YR=YS/TS). As described above, in the seamless steel pipe according to the present embodiment, if the yield strength is 110 ksi grade and the yield ratio is 90.0% or more, the total of the volume ratios of tempered martensite and tempered bainite in the microstructure is 90% or more. As a result, in the seamless steel pipe according to the present embodiment, both a yield strength of 110 ksi grade and excellent HIC resistance can be obtained.

The yield strength and the yield ratio of the seamless steel pipe according to the present embodiment can be determined by the following method. A tensile test is performed in accordance with ASTM E8/E8M (2013). A round bar test specimen is taken from a center portion of the wall thickness of the seamless steel pipe according to the present embodiment. Regarding the size of the round bar test specimen, for example, the round bar test specimen has a parallel portion diameter of 8.9 mm and a parallel portion length of 35.6 mm. Note that the axial direction of the round bar test specimen is parallel to the pipe axis direction of the seamless steel pipe. A tensile test is performed in the atmosphere at normal temperature (25° C.) using the round bar test specimen. The stress obtained at the time of 0.7% total elongation is defined as the yield strength (MPa). The largest stress during uniform elongation is defined as the tensile strength (MPa). The ratio of the yield strength (YS) to the tensile strength (TS) (YR=YS/TS) is defined as the yield ratio (YR) (%).

[Regarding HIC Resistance]

An HIC resistance test for the seamless steel pipe according to the present embodiment can be performed by a method in accordance with NACE TM0284-2011. A test specimen for HIC resistance test is prepared from the seamless steel pipe according to the present embodiment. Specifically, a part having an arc-shape in the pipe circumferential direction is taken from the seamless steel pipe according to the present embodiment. Two curved surfaces of the taken part (corresponding to the outer surface and the inner surface of the seamless steel pipe) are machined so as to planes parallel to each other. In this case, the thickness of the taken part is reduced to the wall thickness of the seamless steel pipe −2 mm. In this manner, a test specimen having a rectangular cross section and having a width of 20 mm, thickness of −2 mm from the wall thickness of the seamless steel pipe and a length of 100 mm is prepared. Note that, the length direction of the test specimen is parallel to the pipe axis direction of the seamless steel pipe, and the thickness direction of the test specimen is parallel to the pipe radial direction.

A mixed aqueous solution containing 5.0 mass % of sodium chloride and 0.5 mass % of acetic acid (NACE solution A) is used as the test solution. The prepared test specimen is immersed in the test solution at 24° C. $N_2$ gas is blown into the test solution for three hours to degas the test solution. After the test solution is degassed, $H_2S$ at 1 atm is blown therein to make a corrosive environment, and this is adopted as a test bath. The test specimen is held in the test bath for 96 hours while stiffing the test bath. The test specimen is taken out from the test bath after being held for 96 hours. After the test specimen is taken out, an ultrasonic flaw detection test (C-scan) is performed thereon to determine the area of indication portions (HIC occurrence portions).

The cracking area ratio CAR (%) can be determined from the following Formula (2) based on the area of indication portions that was determined and the projected area of the test specimen during the ultrasonic flaw detection test. Note that, in the present embodiment, the projected area is, for example, 20 mm×100 mm.

$$\text{CAR (\%)}=(\text{area of indication portions/projected area})\times 100 \quad (2)$$

For the seamless steel pipe according to the present embodiment, in the HIC resistance test, the cracking area ratio CAR (%) after 96 hours elapsed is less than 3.0%.

[Production Method]

A method for producing the seamless steel pipe according to the present embodiment will now be described. The production method described hereunder is one example of a method for producing the seamless steel pipe according to the present embodiment. In other words, a method for producing the seamless steel pipe according to the present embodiment is not limited to the production method described hereunder.

One example of the production method includes: a steel making process of refining and casting molten steel to produce a starting material (a cast piece, an ingot or a billet); a hot working process of subjecting the starting material to hot working to produce a hollow shell; a quenching process of subjecting the hollow shell to quenching; and a tempering process of subjecting the quenched hollow shell to tempering.

[Steel Making Process]

In the steel making process, first, hot metal that was produced by a well-known method is subjected to refining (primary refining) using a converter. The molten steel that underwent primary refining is then subjected to secondary refining. In the secondary refining, alloying elements that were subjected to composition adjustment are added to the molten steel to thereby produce a molten steel satisfying the aforementioned chemical composition.

Specifically, molten steel that was tapped from the converter is subjected to a deoxidation treatment. The deoxidation treatment is not particularly limited, and it suffices that the deoxidation treatment is performed using an element other than REM and Ca. The deoxidation treatment is performed, for example, by adding Al. In a case where Al is added in the deoxidation treatment, the oxygen content in the molten steel can be efficiently reduced. Therefore, in the present embodiment, it is preferable to add Al in the Al in the deoxidation treatment. After the deoxidation treatment, a deslagging treatment is performed. After performing the deslagging treatment, secondary refining is performed.

In the secondary refining, for example, an RH (Ruhrstahl-Hausen) vacuum degassing process is performed. Thereafter, final adjustment of alloy elements is performed. In the secondary refining, composite refining may be performed. In such a case, prior to the RH vacuum degassing process, for example, a refining treatment that uses an LF (ladle furnace) or VAD (vacuum arc degassing) is performed.

In the final adjustment of the alloy elements, first, adjustment of alloy elements other than REM and Ca is performed. That is, alloy elements other than REM and Ca in the molten steel are adjusted so as to obtain the aforementioned chemical composition. Thereafter, after adding at least one type of element among the REM elements, Ca is added, and the alloy elements in the molten steel are adjusted so as to obtain the aforementioned chemical composition. Note that, when adding REM to the molten steel, REM may be used as the simple substance and also may be used as the form of Mischmetal.

As described above, REM suppresses the formation of $Al_2O_3$ clusters by reducing FeO. As a result, the inclusions $Al_2O_3$, $X_2O_3$ and $X_2OS$ ("X" represents REM) are formed in the molten steel. In a case where Ca is added to the molten steel after these inclusions are formed, XCaAlOS ("X" represents REM) which are fine inclusions is formed.

On the other hand, if Ca is added to the molten steel before adding REM, calcium aluminates ($kCaO\text{-}lAl_2O_3$; where k and l are natural numbers) that are coarse inclusions are formed. In this case, formation of the aforementioned fine inclusions XCaAlOS ("X" represents REM) is hindered. Therefore, in a case where REM is added after adding Ca to the molten steel, reforming of inclusions does not proceed, and the effect of containing REM is not effectively obtained.

Furthermore, calcium aluminates are also formed even if Ca is added to the molten steel immediately after adding REM. Specifically, if the time from adding REM to adding Ca (hereunder, also referred to as "molten steel retention time") is less than 15 seconds, calcium aluminates are formed and formation of the XCaAlOS ("X" represents REM) is hindered. As a result, the predicted maximum major axis of inclusions Dmax is more than 150 μm, the HIC resistance of the seamless steel pipe decreases.

On the other hand, if the time from adding REM to adding Ca is too long, reforming of inclusions does not proceed in some cases. Specifically, if the molten steel retention time is more than 600 seconds, the predicted maximum major axis of inclusions Dmax is more than 150 μm, and the HIC resistance of the seamless steel pipe decreases. Although the detailed reason has not been clarified, in a case where the molten steel retention time is too long, it is considered that the inclusions $X_2O_3$ and $X_2OS$ ("X" represents REM) in the molten steel decrease and the XCaAlOS ("X" represents REM) is unlikely formed.

Therefore, in the steel making process according to the present embodiment, the molten steel retention time is 15 to 600 seconds. If the molten steel retention time is 15 to 600 seconds, formation of the calcium aluminates is suppressed and formation of the XCaAlOS ("X" represents REM) which are fine inclusions is accelerated. As a result, the maximum major axis of inclusions contained in a seamless steel pipe that is predicted by extreme value statistical processing may be 150 μm or less.

The starting material is produced using the molten steel produced by the aforementioned method. Specifically, a cast piece (a slab, bloom or billet) is produced by a continuous casting process using the molten steel. An ingot may also be produced by an ingot-making process using the molten steel. As necessary, the slab, bloom or ingot may be subjected to blooming to produce a billet. The starting material (a slab, bloom, ingot or billet) is produced by the above described process.

[Hot Working Process]

In the hot working process, the starting material that was prepared is subjected to hot working to produce a hollow shell. First, the billet is heated in a heating furnace. Although the heating temperature is not particularly limited, for example, the heating temperature is within a range of 1100 to 1300° C. The billet that is extracted from the heating furnace is subjected to hot working to produce a hollow shell.

For example, the Mannesmann process is performed as the hot working to produce the hollow shell. In this case, a round billet is piercing-rolled using a piercing machine. When performing piercing-rolling, although the piercing ratio is not particularly limited, the piercing ratio is, for example, within a range of 1.0 to 4.0. The round billet that underwent piercing-rolling is further hot-rolled to form a hollow shell using a mandrel mill, a reducer, a sizing mill or the like. The cumulative reduction of area in the hot working process is, for example, 20 to 70%.

A hollow shell may also be produced from the billet by another hot working method. For example, in the case of a heavy-wall steel material of a short length such as a coupling, a hollow shell may be produced by forging by the Ehrhardt process or the like. A hollow shell is produced by the above process. Although not particularly limited, the wall thickness of the hollow shell is, for example, 9 to 60 mm.

The hollow shell produced by hot working may be air-cooled (as-rolled). The hollow shell produced by hot working may be subjected to direct quenching after hot working without being cooled to normal temperature, or may be subjected to quenching after undergoing supplementary heating (reheating) after hot working. However, in the case of performing direct quenching or quenching after supplementary heating, it is preferable to stop the cooling midway through the quenching process and conduct slow cooling for the purpose of suppressing quench cracking.

In a case where direct quenching is performed after hot working, or quenching is performed after supplementary heating after hot rolling, for the purpose of eliminating residual stress it is preferable to perform a stress relief (SR treatment) at a time that is after quenching and before the heat treatment (quenching and the like) of the next process.

[Quenching Process]

In the quenching process, the hollow shell that was produced by hot working is subjected to quenching. In the present description, the term "quenching" means rapidly cooling the hollow shell that is at a temperature not less than the $A_3$ point. The quenching may be performed by a well-known method, and is not particularly limited. A quenching temperature is 800 to 1000° C., for example.

In a case where direct quenching is performed after hot working, the quenching temperature corresponds to the surface temperature of the hollow shell that is measured by a thermometer placed on the exit side of the apparatus that performs the final hot working. Further, in a case where quenching is performed using a supplementary heating furnace or a heat treatment furnace after hot working, the quenching temperature corresponds to the temperature of the supplementary heating furnace or the heat treatment furnace.

The quenching method, for example, continuously cools the hollow shell from the quenching starting temperature, and continuously decreases the temperature of the hollow shell. The method of performing the continuous cooling treatment is not particularly limited, and a well-known method can be used. The method of performing the continuous cooling treatment is, for example, a method that cools the hollow shell by immersing the hollow shell in a water bath, or a method that cools the hollow shell in an accelerated manner by shower water cooling or mist cooling.

If the cooling rate during quenching is too slow, the microstructure does not become one that is principally composed of martensite and bainite, and the mechanical properties defined in the present embodiment cannot be obtained. Therefore, in the method for producing the seamless steel pipe according to the present embodiment, the hollow shell is rapidly cooled during quenching.

Specifically, in the quenching process, the average cooling rate when the temperature of the hollow shell is within the range of 800 to 500° C. during quenching is defined as a cooling rate during quenching $CR_{800\text{-}500}$ (° C./sec). More specifically, the cooling rate during quenching $CR_{800\text{-}500}$ is determined based on a temperature that is measured at a region that is most slowly cooled within a cross-section of the hollow shell that is being quenched (for example, in the case of forcedly cooling both the outer surface and inner surface of the hollow shell, the cooling rate is measured at the center portion of the wall thickness of the hollow shell).

A preferable cooling rate during quenching $CR_{800\text{-}500}$ is 8° C./sec or higher. In this case, the microstructure of the hollow shell after quenching stably becomes a microstructure that is principally composed of martensite and bainite. A more preferable lower limit of the cooling rate during quenching $CR_{800\text{-}500}$ is 10° C./sec. A preferable upper limit of the cooling rate during quenching $CR_{800\text{-}500}$ is 500° C./sec.

Preferably, quenching is performed after performing heating of the hollow shell in the austenite zone a plurality of times. In this case, SSC resistance and low-temperature toughness of the seamless steel pipe increases because austenite grains are refined prior to quenching. Heating in the austenite zone may be repeated a plurality of times by performing quenching a plurality of times, or heating in the austenite zone may be repeated a plurality of times by performing normalizing and quenching.

[Tempering Process]

In the tempering process, the hollow shell that underwent quenching is subjected to tempering. In the present description, the term "tempering" means reheating the hollow shell after quenching to a temperature that is not more than the $A_{c1}$ point and holding the hollow shell at that temperature. The tempering temperature is appropriately adjusted in accordance with the chemical composition of the seamless steel pipe and the yield strength, which is to be obtained. That is, with respect to the hollow shell having the chemical composition of the present embodiment, the tempering temperature is adjusted so as to adjust the yield strength of the seamless steel pipe to within the range of 758 to 862 MPa (110 ksi grade).

The tempering temperature corresponds to the temperature of the furnace when the hollow shell after quenching is heated and held at the relevant temperature. In the tempering process according to the present embodiment, a preferable tempering temperature is 650 to 720° C. A more preferable lower limit of the tempering temperature is 655° C., and further preferably is 660° C. A more preferable upper limit of the tempering temperature is 715° C., and further preferably is 710° C.

The term "tempering time" means the period of time from the time that the hollow shell after quenching is inserted into the furnace to be heated and held, until the time that the hollow shell is taken out from the furnace. If the tempering time is too short, a microstructure that is principally composed of tempered martensite and tempered bainite will not be obtained in some cases. On the other hand, if the tempering time is too long, the aforementioned effects are saturated. Therefore, in the tempering process of the present embodiment, the tempering time is preferably set within the range of 10 to 180 minutes. A more preferable lower limit of the tempering time is 15 minutes. A more preferable upper limit of the tempering time is 120 minutes, and further preferably is 90 minutes.

The seamless steel pipe according to the present embodiment can be produced by the production method that is described above. Note that, the aforementioned production method is one example, and the seamless steel pipe according to the present embodiment may be produced by another production method.

EXAMPLE

Molten steels having the chemical compositions shown in Table 1 were produced. Further, the values of Fn1 obtained based on the chemical compositions shown in Table 1 and the aforementioned Formula (1) are shown in Table 2. Note that, with respect to Fn1, in a case where a corresponding element is not contained, "0" is substituted for the symbol of the relevant element.

TABLE 1

| Test | Chemical Composition (Unit is mass %; balance is Fe and impurities) | | | | | | | | | | |
|---|---|---|---|---|---|---|---|---|---|---|---|
| Number | C | Si | Mn | P | S | Al | Cr | Mo | Ti | Nb | B |
| 1 | 0.24 | 0.29 | 0.45 | 0.006 | 0.0012 | 0.026 | 1.00 | 0.68 | 0.008 | 0.025 | 0.0011 |
| 2 | 0.26 | 0.23 | 0.42 | 0.008 | 0.0006 | 0.025 | 1.02 | 0.45 | 0.004 | 0.026 | 0.0012 |
| 3 | 0.27 | 0.30 | 0.45 | 0.005 | 0.0009 | 0.025 | 0.50 | 1.20 | 0.009 | 0.026 | 0.0011 |
| 4 | 0.27 | 0.25 | 0.34 | 0.007 | 0.0011 | 0.026 | 0.51 | 0.75 | 0.006 | 0.025 | 0.0015 |
| 5 | 0.26 | 0.22 | 0.44 | 0.008 | 0.0012 | 0.036 | 1.05 | 0.47 | 0.006 | 0.028 | 0.0015 |
| 6 | 0.27 | 0.30 | 0.42 | 0.007 | 0.0008 | 0.025 | 1.02 | 0.71 | 0.004 | 0.025 | 0.0013 |
| 7 | 0.28 | 0.35 | 0.45 | 0.008 | 0.0011 | 0.025 | 0.75 | 0.95 | 0.007 | 0.027 | 0.0012 |
| 8 | 0.23 | 0.20 | 0.55 | 0.007 | 0.0013 | 0.032 | 0.75 | 0.93 | 0.007 | 0.029 | 0.0012 |
| 9 | 0.29 | 0.25 | 0.55 | 0.007 | 0.0012 | 0.025 | 0.75 | 1.22 | 0.006 | 0.025 | 0.0013 |
| 10 | 0.32 | 0.35 | 0.45 | 0.006 | 0.0011 | 0.036 | 0.81 | 1.21 | 0.006 | 0.027 | 0.0014 |
| 11 | 0.27 | 0.32 | 0.45 | 0.006 | 0.0011 | 0.026 | 1.00 | 0.70 | 0.006 | 0.027 | 0.0008 |
| 12 | 0.26 | 0.29 | 0.45 | 0.006 | 0.0012 | 0.026 | 1.00 | 0.65 | 0.004 | 0.025 | 0.0009 |
| 13 | 0.33 | 0.35 | 0.25 | 0.009 | 0.0009 | 0.072 | 0.92 | 0.93 | 0.008 | 0.029 | 0.0015 |
| 14 | 0.32 | 0.29 | 0.35 | 0.008 | 0.0007 | 0.035 | 0.83 | 0.87 | 0.004 | 0.028 | 0.0015 |
| 15 | 0.27 | 0.23 | 0.27 | 0.008 | 0.0065 | 0.020 | 1.05 | 0.92 | 0.008 | 0.026 | 0.0012 |
| 16 | 0.23 | 0.27 | 0.26 | 0.008 | 0.0013 | 0.020 | 1.06 | 0.68 | 0.009 | 0.025 | 0.0013 |
| 17 | 0.28 | 0.25 | 0.46 | 0.006 | 0.0045 | 0.026 | 1.00 | 0.68 | 0.008 | 0.025 | 0.0011 |

| Test | Chemical Composition (Unit is mass %; balance is Fe and impurities) | | | | | | | | | | |
|---|---|---|---|---|---|---|---|---|---|---|---|
| Number | REM | Ca | N | O | V | Mg | Zr | Co | W | Ni | Cu |
| 1 | 0.0009 | 0.0012 | 0.0033 | 0.0015 | — | — | — | — | — | — | — |
| 2 | 0.0010 | 0.0013 | 0.0035 | 0.0013 | 0.09 | — | — | — | — | — | — |
| 3 | 0.0005 | 0.0014 | 0.0042 | 0.0012 | — | — | — | — | — | — | 0.05 |
| 4 | 0.0006 | 0.0015 | 0.0045 | 0.0011 | — | — | — | — | — | 0.05 | — |
| 5 | 0.0006 | 0.0015 | 0.0045 | 0.0012 | — | — | — | — | — | — | — |
| 6 | 0.0004 | 0.0012 | 0.0033 | 0.0013 | — | 0.0015 | — | — | — | — | — |
| 7 | 0.0005 | 0.0011 | 0.0034 | 0.0014 | — | — | 0.0015 | — | — | — | — |
| 8 | 0.0004 | 0.0010 | 0.0035 | 0.0013 | — | — | — | 0.80 | — | — | — |
| 9 | 0.0005 | 0.0010 | 0.0032 | 0.0012 | 0.09 | — | — | — | 1.00 | — | 0.05 |
| 10 | 0.0005 | 0.0009 | 0.0045 | 0.0011 | 0.10 | — | 0.0012 | — | — | 0.04 | — |
| 11 | 0.0009 | 0.0012 | 0.0033 | 0.0015 | — | — | — | — | — | — | — |
| 12 | 0.0009 | 0.0012 | 0.0033 | 0.0015 | — | — | — | — | — | — | — |
| 13 | 0.0004 | 0.0010 | 0.0048 | 0.0013 | 0.10 | — | — | — | 0.50 | — | — |
| 14 | 0.0035 | 0.0011 | 0.0045 | 0.0012 | 0.09 | — | — | — | — | — | — |
| 15 | 0.0005 | 0.0014 | 0.0042 | 0.0011 | 0.09 | — | — | — | — | — | — |
| 16 | 0.0008 | 0.0014 | 0.0035 | 0.0055 | 0.09 | — | — | — | — | — | — |
| 17 | 0.0009 | 0.0012 | 0.0033 | 0.0015 | 0.09 | — | — | — | — | — | — |

TABLE 2

| Test Number | Fn1 | Molten Steel Retention Time. | Tempering Temperature (° C.) | Tempering Time (min) | Dmax (μm) | YS (MPa) | TS (MPa) | YR (%) | CAR (%) |
|---|---|---|---|---|---|---|---|---|---|
| 1 | 47.3 | A | 680 | 45 | 138 | 835 | 914 | 91.4 | <3.0 |
| 2 | 74.2 | A | 705 | 45 | 78 | 798 | 868 | 91.9 | <3.0 |
| 3 | 53.6 | A | 680 | 45 | 57 | 840 | 913 | 92.0 | <3.0 |
| 4 | 52.7 | A | 680 | 45 | 128 | 832 | 923 | 90.2 | <3.0 |
| 5 | 66.8 | A | 680 | 45 | 135 | 800 | 871 | 91.8 | <3.0 |
| 6 | 55.3 | A | 680 | 45 | 120 | 840 | 918 | 91.5 | <3.0 |
| 7 | 45.8 | A | 690 | 30 | 128 | 776 | 853 | 91.0 | <3.0 |

TABLE 2-continued

| Test Number | Fn1 | Molten Steel Retention Time. | Tempering Temperature (° C.) | Tempering Time (min) | Dmax (μm) | YS (MPa) | TS (MPa) | YR (%) | CAR (%) |
|---|---|---|---|---|---|---|---|---|---|
| 8 | 54.8 | A | 690 | 30 | 113 | 769 | 850 | 90.5 | <3.0 |
| 9 | 47.6 | A | 690 | 30 | 50 | 855 | 944 | 90.6 | <3.0 |
| 10 | 75.8 | A | 690 | 80 | 91 | 814 | 891 | 91.4 | <3.0 |
| 11 | 49.7 | S | 680 | 45 | 189 | 835 | 914 | 91.4 | 5.2 |
| 12 | 47.3 | L | 680 | 45 | 220 | 831 | 917 | 90.6 | 4.5 |
| 13 | 150.8 | A | 700 | 30 | 244 | 774 | 858 | 90.2 | 5.7 |
| 14 | 151.0 | A | 700 | 60 | 152 | 780 | 866 | 90.0 | 8.0 |
| 15 | 23.4 | A | 680 | 90 | 250 | 806 | 889 | 90.7 | 4.2 |
| 16 | 22.1 | A | 690 | 30 | 167 | 828 | 902 | 91.8 | 9.8 |
| 17 | 28.1 | A | 690 | 50 | 248 | 779 | 865 | 90.1 | 9.6 |

The molten steels of the respective test numbers were produced by the following method. Hot metals produced by a well-known method were subjected to primary refining under the same conditions using a converter. After being tapped from the converter, Al was added to the molten steel to perform a deoxidation treatment, and thereafter a deslagging treatment was performed. Subsequently, after performing an RH vacuum degassing process, adjustment of the composition of alloying elements other than REM and Ca in the molten steel was performed. Next, REM was added to the molten steel, and thereafter Ca was added to the molten steel, and composition adjustment was performed.

For each of the test numbers, the time from adding REM to adding Ca (the molten steel retention timed is shown in Table 2. In a "Molten Steel Retention Time" column of Table 2, "A" (Appropriate) means that the molten steel retention time is 15 to 600 seconds. In a "Molten Steel Retention Time" column of Table 2, "S" (Short) means that the molten steel retention time is less than 15 seconds. In a "Molten Steel Retention Time" column of Table 2, "L" (Long) means that the molten steel retention time is more than 600 seconds.

Billets having a cross-sectional diameter of 310 mm were produced by a continuous casting process using the molten steel of each test number. The produced billets were hot-rolled to produce hollow shells (seamless steel pipe) having an outer diameter of 244.48 mm, a wall thickness of 13.84 mm and a length of 12000 mm. The produced hollow shell of each test number was allowed to cool to bring the surface temperature of the hollow shell to normal temperature (25° C.).

The hollow shell of each test number was subjected to quenching. Specifically, after being allowed to cool as described above, the hollow shell of each test number was held for 10 minutes in a quenching furnace at 920° C. After been held for 10 minutes, the hollow shell of each test number was immersed in a water bath to perform water cooling. At this time, the cooling rate during quenching $CR_{800\text{-}500}$ was at least 300° C./min.

After the water cooling, the hollow shell of each test number was subjected to tempering to produce a seamless steel pipe of each test number. The tempering temperature was adjusted so that the hollow shell of each test number was of 110 ksi grade (yield strength within the range of 758 to 862 MPa) according to the API standards. Specifically, the tempering temperature (° C.) and tempering time (min) for the tempering of the hollow shell of each test number are shown in Table 2.

[Evaluation Tests]

A tensile test, a predicted maximum major axis of inclusions measurement test and an HIC resistance evaluation test that are described hereunder were performed on the seamless steel pipe of each test number after the aforementioned tempering.

[Tensile Test]

A tensile test was performed in conformity with ASTM E8/E8M (2013). Round bar test specimens having a parallel portion diameter of 8.9 mm and a parallel portion length of 35.6 mm were prepared from the center portion of the wall thickness of the seamless steel pipe of each test number. The axial direction of the round bar test specimens was parallel to the axial direction of the seamless steel pipe. A tensile test was performed in the atmosphere at normal temperature (25° C.) using each round bar test specimen, and the yield strength YS (MPa), tensile strength TS (MPa), and yield ratio YR (%) of the seamless steel pipe of each test number were obtained. Note that, in the present examples, stress at the time of 0.7% total elongation obtained in the tensile test was defined as the yield strength YS for each test number. Similarly, the largest stress during uniform elongation obtained in the tensile test was defined as the tensile strength TS for each test number. The ratio (YS/TS) between the obtained yield strength YS and tensile strength TS was taken as the yield ratio YR (%). The obtained yield strength YS (MPa), tensile strength TS (MPa) and yield ratio YR (%) are shown in Table 2.

Referring to Table 2, the yield strength of each test number was within a range of 758 to 862 MPa (110 ksi grade). Further, the yield ratio of each test number was 90.0% or more. Therefore, the microstructure of the seamless steel pipe of each test number was 90% or more of tempered martensite and tempered bainite in volume ratios.

[Predicted Maximum Major Axis of Inclusions Measurement Test]

The predicted maximum major axis of inclusions Dmax (μm) was determined for the seamless steel pipe of each test number using the method described above. Note that, the number of observation visual fields n was 108, and the reference area S0 was 196.5 $mm^2$. In addition, the virtual surface area S at the center portion of the wall thickness of the seamless steel pipe was $8.69\times10^6$ $mm^2$.

[HIC Resistance Evaluation Test of Seamless Steel Pipe]

An HIC resistance evaluation test was performed by the method described above on the seamless steel pipe of each test number. Specifically, the method in accordance with NACE TM0284-2011 was conducted. A test specimen having a rectangular cross section and having a width of 20 mm, a thickness of −2 mm from the wall thickness of the seamless steel pipe and a length of 100 mm was prepared from the seamless steel pipe of each test number. Note that, the length direction of the test specimen was parallel to the pipe axis direction of the seamless steel pipe, and the thickness direction of the test specimen was parallel to the pipe radial direction.

A mixed aqueous solution containing 5.0 mass % of sodium chloride and 0.5 mass % of acetic acid (NACE solution A) was used as the test solution. The test specimens of the respective test numbers that were prepared were immersed in a test solution at 24° C., respectively. The test solution of each test number was degassed by blowing $N_2$ gas into the test bath for three hours.

The degassed test solution of each test number was made a corrosive environment by blowing $H_2S$ at 1 atm, and this was adopted as a test bath. The test specimens of the respective test numbers were held in the test bath of each test number for 96 hours while stirring the test bath. After being held for 96 hours, the test specimens were taken out from the test baths. The test specimens that were taken out from the test baths were subjected to an ultrasonic flaw detection test (C-scan) to determine the area of indication portions (HIC occurrence portions).

The cracking area ratio CAR (%) was determined from the following Formula (2) based on the area of indication portions that was determined and the projected area of the test specimen during the ultrasonic flaw detection test. Note that, the projected area was 20 mm×100 mm.

$$\text{CAR (\%)}=(\text{area of indication portions}/\text{projected area})\times 100 \quad (2)$$

[Test Results]

The test results are shown in Table 2.

Referring to Table 1 and Table 2, for the respective seamless steel pipes of Test Numbers 1 to 10, the chemical composition was appropriate, Fn1 was 40.0 or more, and the yield strength YS was within the range of 758 to 862 MPa (110 ksi grade). In addition, the predicted maximum major axis of inclusions Dmax was 150 μm or less. As a result, in the HIC resistance test, CAR was less than 3.0% and excellent HIC resistance was exhibited.

On the other hand, in the seamless steel pipe of Test Number 11, the molten steel retention time was too short. Consequently, the predicted maximum major axis of inclusions Dmax was more than 150 μm. As a result, in the HIC resistance test, the seamless steel pipe of Test Number 11 did not exhibit excellent HIC resistance.

In the seamless steel pipe of Test Number 12, the molten steel retention time was too long. Consequently, the predicted maximum major axis of inclusions Dmax was more than 150 μm. As a result, in the HIC resistance test, the seamless steel pipe of Test Number 12 did not exhibit excellent HIC resistance.

In the seamless steel pipe of Test Number 13, the Al content was too high. Consequently, the predicted maximum major axis of inclusions Dmax was more than 150 μm. As a result, in the HIC resistance test, the seamless steel pipe of Test Number 13 did not exhibit excellent HIC resistance.

In the seamless steel pipe of Test Number 14, the REM content was too high. Consequently, the predicted maximum major axis of inclusions Dmax was more than 150 μm. As a result, in the HIC resistance test, the seamless steel pipe of Test Number 14 did not exhibit excellent HIC resistance.

In the seamless steel pipe of Test Number 15, the S content was too high. In addition, Fn1 was less than 40.0. Consequently, the predicted maximum major axis of inclusions Dmax was more than 150 μm. As a result, in the HIC resistance test the seamless steel pipe of Test Number 15 did not exhibit excellent HIC resistance.

In the seamless steel pipe of Test Number 16, the O content was too high. In addition, Fn1 was less than 40.0. Consequently, the predicted maximum major axis of inclusions Dmax was more than 150 μm. As a result, in the HIC resistance test, the seamless steel pipe of Test Number 16 did not exhibit excellent HIC resistance.

In the seamless steel pipe of Test Number 17, Fn1 was less than 40.0. Consequently, the predicted maximum major axis of inclusions Dmax was more than 150 μm. As a result, in the HIC resistance test, the seamless steel pipe of Test Number 17 did not exhibit excellent HIC resistance.

An embodiment of the present invention has been described above. However, the embodiment described above is merely an example for implementing the present invention. Accordingly, the present invention is not limited to the above embodiment, and the above embodiment can be appropriately modified and performed within a range that does not deviate from the gist of the present invention.

INDUSTRIAL APPLICABILITY

The seamless steel pipe according to the present invention is widely applicable to seamless steel pipes to be utilized in a severe environment such as a polar region, and preferably can be utilized as a seamless steel pipe that is utilized in an oil well environment, and further preferably can be utilized as oil country tubular goods for casing and tubing.

The invention claimed is:

1. A seamless steel pipe comprising:

a chemical composition consisting of, in mass %,

C: 0.15 to 0.45%,
Si: 0.05 to 1.00%,
Mn: 0.01 to 1.00%,
P: 0.030% or less,
S: 0.0001 to 0.0050%,
Al: 0.005 to 0.070%,
Cr: 0.30 to 1.50%,
Mo: 0.25 to 2.00%,
Ti: 0.002 to 0.020%,
Nb: 0.002 to 0.100%,
B: 0.0005 to 0.0040%,
rare earth metal: 0.0001 to 0.0015%,
Ca: 0.0001 to 0.0100%,
N: 0.0100% or less,
O: 0.0001 to 0.0020%,
V: 0 to 0.30%,
Mg: 0 to 0.0100%,
Zr: 0 to 0.0100%,
Co: 0 to 1.00%,
W: 0 to 1.00%,
Ni: 0 to 0.50%,
Cu: 0 to 0.50%, and with the balance being Fe and impurities, and satisfying Formula (1), wherein a maximum major axis of inclusions in the seamless steel pipe is 150 μm or less, the maximum major axis being predicted by means of extreme value statistical processing, and a yield strength is within a range of 758 to 862 MPa:

$$(Ca/O+Ca/S+0.285\times REM/O+0.285\times REM/S)\times(Al/Ca)\geq 40.0 \quad (1)$$

where, a content (mass %) of a corresponding element is substituted for each symbol of an element in Formula (1).

2. The seamless steel pipe according to claim 1, wherein the chemical composition contains:

V: 0.01 to 0.30%.

3. The seamless steel pipe according to claim 2, wherein the chemical composition contains one or more types of element selected from the group consisting of:

Ni: 0.01 to 0.50%, and

Cu: 0.01 to 0.50%.

4. The seamless steel pipe according to claim 2, wherein the chemical composition contains one or more types of element selected from the group consisting of:

Co: 0.02 to 1.00%, and

W: 0.02 to 1.00%.

5. The seamless steel pipe according to claim 4, wherein the chemical composition contains one or more types of element selected from the group consisting of:

Ni: 0.01 to 0.50%, and

Cu: 0.01 to 0.50%.

6. The seamless steel pipe according to claim 2, wherein the chemical composition contains one or more types of element selected from the group consisting of:

Mg: 0.0001 to 0.0100%, and

Zr: 0.0001 to 0.0100%.

7. The seamless steel pipe according to claim 6, wherein the chemical composition contains one or more types of element selected from the group consisting of:

Ni: 0.01 to 0.50%, and

Cu: 0.01 to 0.50%.

8. The seamless steel pipe according to claim 6, wherein the chemical composition contains one or more types of element selected from the group consisting of:

Co: 0.02 to 1.00%, and

W: 0.02 to 1.00%.

9. The seamless steel pipe according to claim 8, wherein the chemical composition contains one or more types of element selected from the group consisting of:

Ni: 0.01 to 0.50%, and

Cu: 0.01 to 0.50%.

10. The seamless steel pipe according to claim 1, wherein the chemical composition contains one or more types of element selected from the group consisting of:

Mg: 0.0001 to 0.0100%, and

Zr: 0.0001 to 0.0100%.

11. The seamless steel pipe according to claim 10, wherein the chemical composition contains one or more types of element selected from the group consisting of:

Ni: 0.01 to 0.50%, and

Cu: 0.01 to 0.50%.

12. The seamless steel pipe according to claim 10, wherein the chemical composition contains one or more types of element selected from the group consisting of:

Co: 0.02 to 1.00%, and

W: 0.02 to 1.00%.

13. The seamless steel pipe according to claim 12, wherein the chemical composition contains one or more types of element selected from the group consisting of:

Ni: 0.01 to 0.50%, and

Cu: 0.01 to 0.50%.

14. The seamless steel pipe according to claim 1, wherein the chemical composition contains one or more types of element selected from the group consisting of:

Co: 0.02 to 1.00%, and

W: 0.02 to 1.00%.

15. The seamless steel pipe according to claim 14, wherein the chemical composition contains one or more types of element selected from the group consisting of:

Ni: 0.01 to 0.50%, and

Cu: 0.01 to 0.50%.

16. The seamless steel pipe according to claim 1, wherein the chemical composition contains one or more types of element selected from the group consisting of:

Ni: 0.01 to 0.50%, and

Cu: 0.01 to 0.50%.

17. The seamless steel pipe according to claim 1, wherein the seamless steel pipe is an oil-well steel pipe.

* * * * *